US005733169A

United States Patent [19]

Tsai

[11] Patent Number: 5,733,169

[45] Date of Patent: Mar. 31, 1998

[54] TOY AIRPLANE WITH ROTARY DECORATIVE BODIES

[76] Inventor: Wen Ho Tsai, 8 Floor, No.113, Yu Jen Road, Taipei, Taiwan

[21] Appl. No.: 690,180

[22] Filed: Jul. 25, 1996

[51] Int. Cl.[6] ..... A63H 27/00

[52] U.S. Cl. ..... 446/230; 446/237; 446/437; 446/465

[58] Field of Search ..... 446/230, 236, 446/237, 431, 437, 465, 470

[56] References Cited

U.S. PATENT DOCUMENTS

| | | | |
|---|---|---|---|
| 1,609,167 | 11/1926 | Heyman | 446/230 |
| 2,443,519 | 6/1948 | Sadofsky | 446/437 |
| 4,467,556 | 8/1984 | Iwao et al. | 446/230 |
| 5,139,456 | 8/1992 | Chuang | 446/236 |
| 5,641,317 | 6/1997 | Huang | 446/232 |

*Primary Examiner*—Robert A. Hafer
*Assistant Examiner*—Jeffrey D. Carlson
*Attorney, Agent, or Firm*—Pro-Techtor International

[57] ABSTRACT

A toy airplane with rotary decorative bodies, which includes a motor for driving a gear set. The gear set in turn drives a rotary power wheel set and two opposite cams to rotate. Each cam is formed with a guiding groove along its periphery for guiding a rocking arm to regularly swing therewithin. The rocking arm further drives a resilient linking member which drives an ascending/descending support shaft to move up and down for pushing a rotary shaft and changing the engagement state between a gear disposed at middle section thereof and the gear set, whereby the rotary shaft is rotated in cooperation with the ascending/descending of the ascending/descending support shaft so as to drive the decorative body disposed at the end portion of the rotary shaft to rotate and create an entertaining effect.

5 Claims, 7 Drawing Sheets

TOY AIRPLANE WITH ROTARY DECORATIVE BODIES

BACKGROUND OF THE INVENTION

The present invention relates to a toy airplane having decorative bodies above the body of the airplane. After activated, the airplane can run over the ground, ascend or descend with the decorative bodies rotated.

Some of the conventional toy airplanes are manufactured at low cost and have simple profiles and appearances. Such toy airplanes may be designed with monotonous movement without special attractivity. Some other conventional toy airplanes are manufactured at relatively high cost and designed with more versatile movements. Such toy airplanes include complicated transmission mechanisms which are subject to failure after a period of use. Therefore, it is necessary to provide a toy airplane which is manufactured at low cost, while being able to durably present versatile movements.

SUMMARY OF THE INVENTION

It is a primary object of the present invention to provide a toy airplane which is manufactured at low cost and includes simple transmission mechanism and decorative bodies above the body of the airplane, whereby the airplane can present versatile movements such as running over the ground, ascending or descending with the decorative bodies rotated.

The present invention can be best understood through the following description and accompanying drawings, wherein:

BRIEF DESCRIPTION OF THE DRAWINGS

FIG. 3-B shows the internal operation according to FIG. 3-A;

FIG. 4-B shows the internal operation according to FIG. 4-A; and

DETAILED DESCRIPTION OF THE PREFERRED EMBODIMENT

Figure 1:
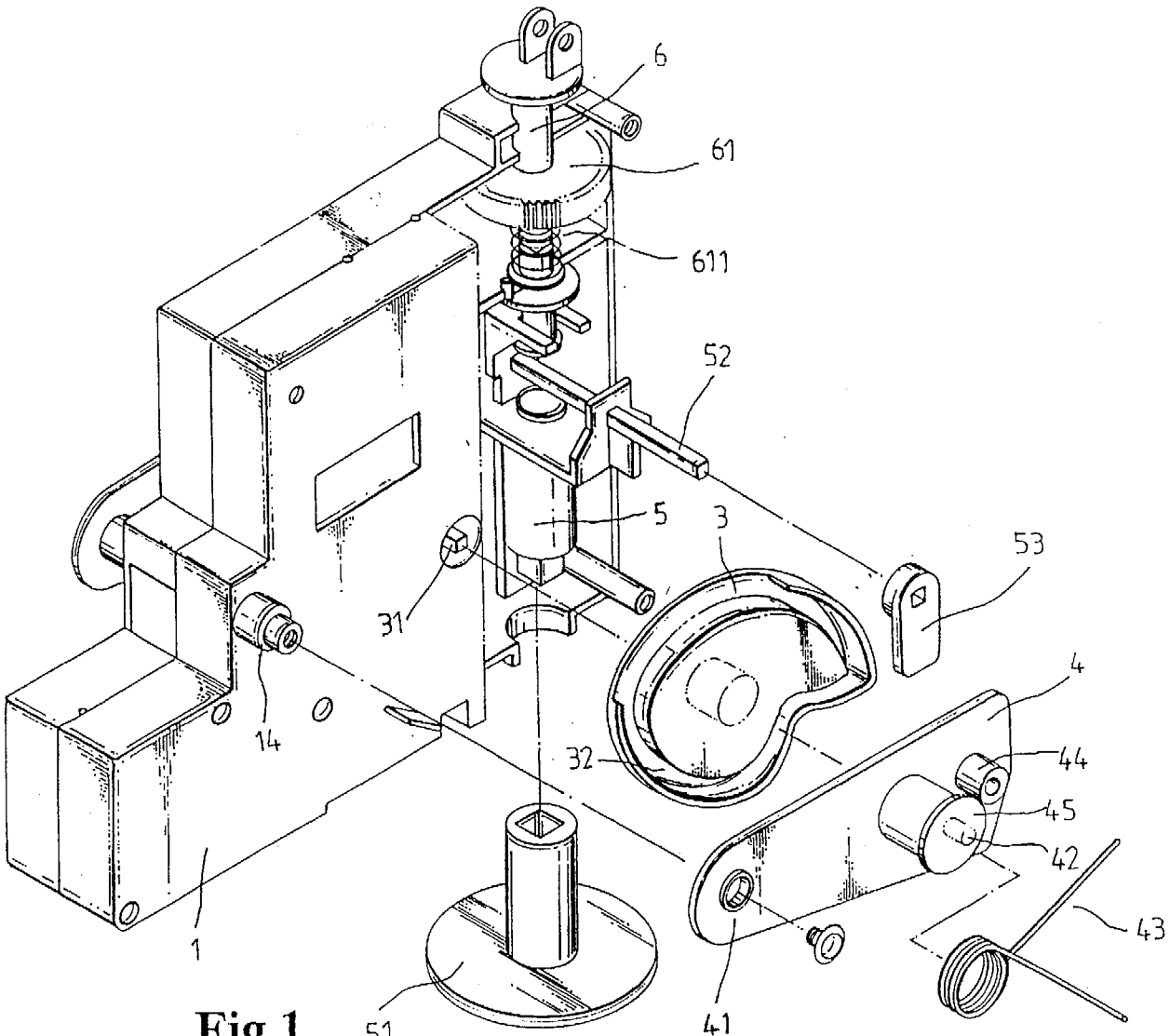
FIG. 1 is a perspective exploded view of the present invention.
Figure 2:
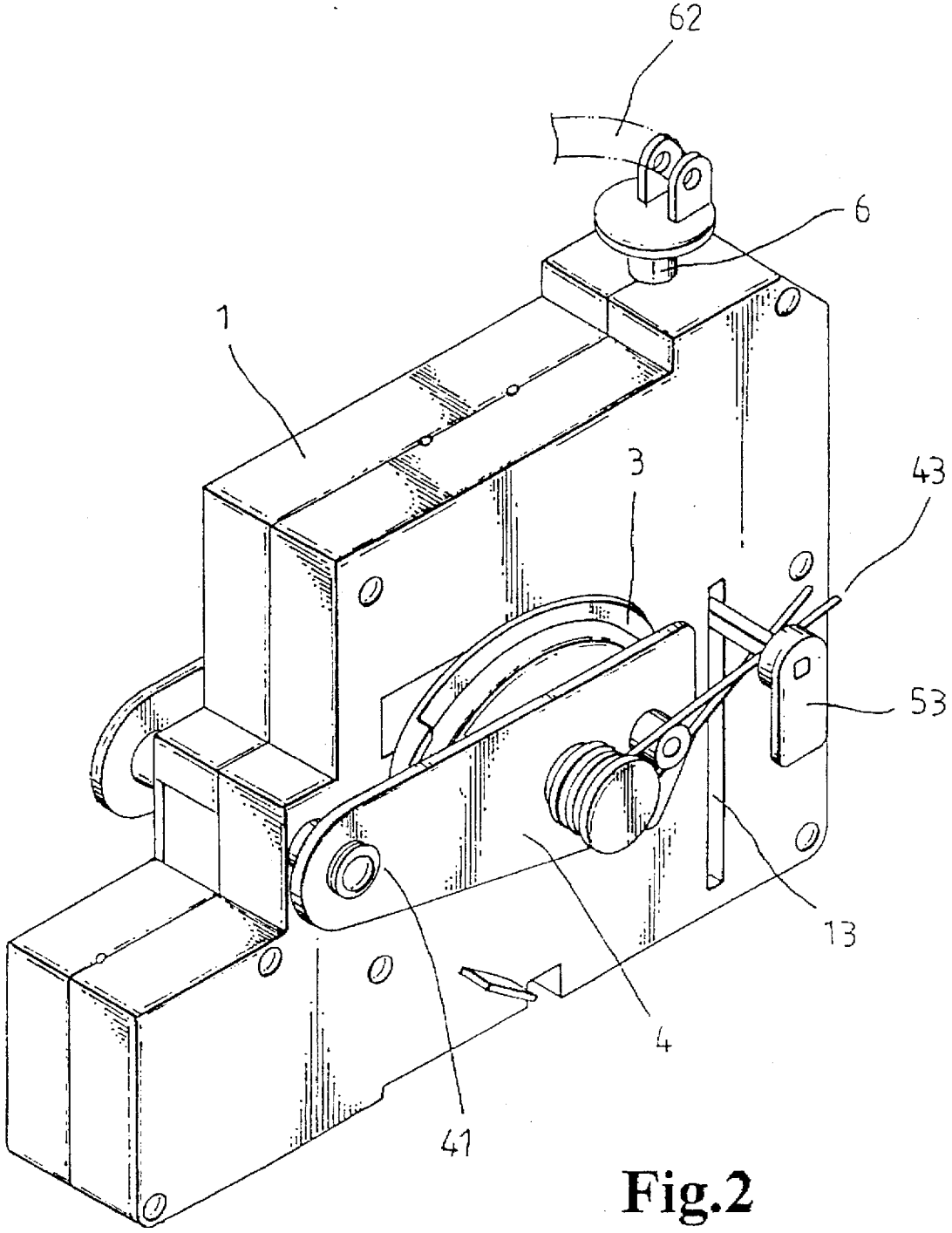
FIG. 2 is a perspective assembled view of the present invention.
Figure 3A:
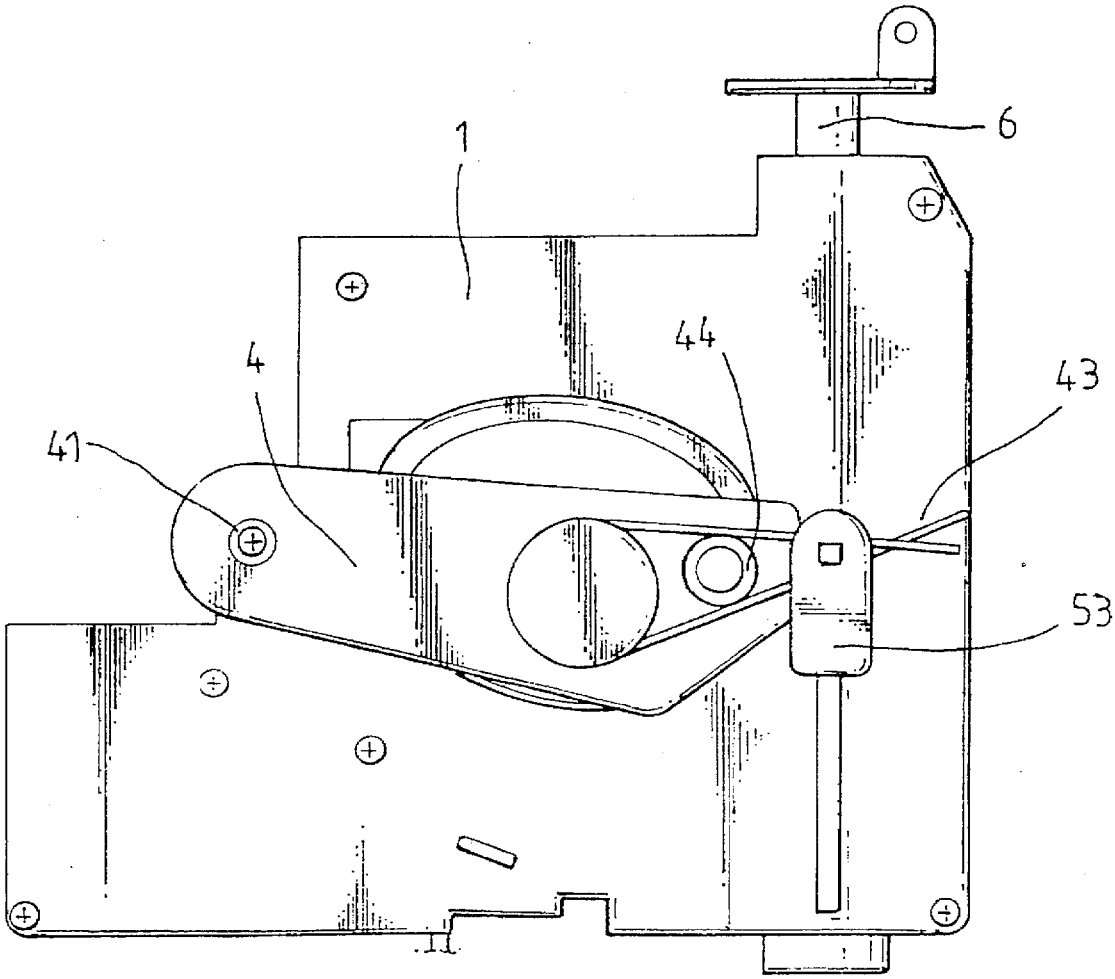
FIG. 3-A shows that the rocking arm drives the ascending/descending support shaft to ascend.
Figure 3B:
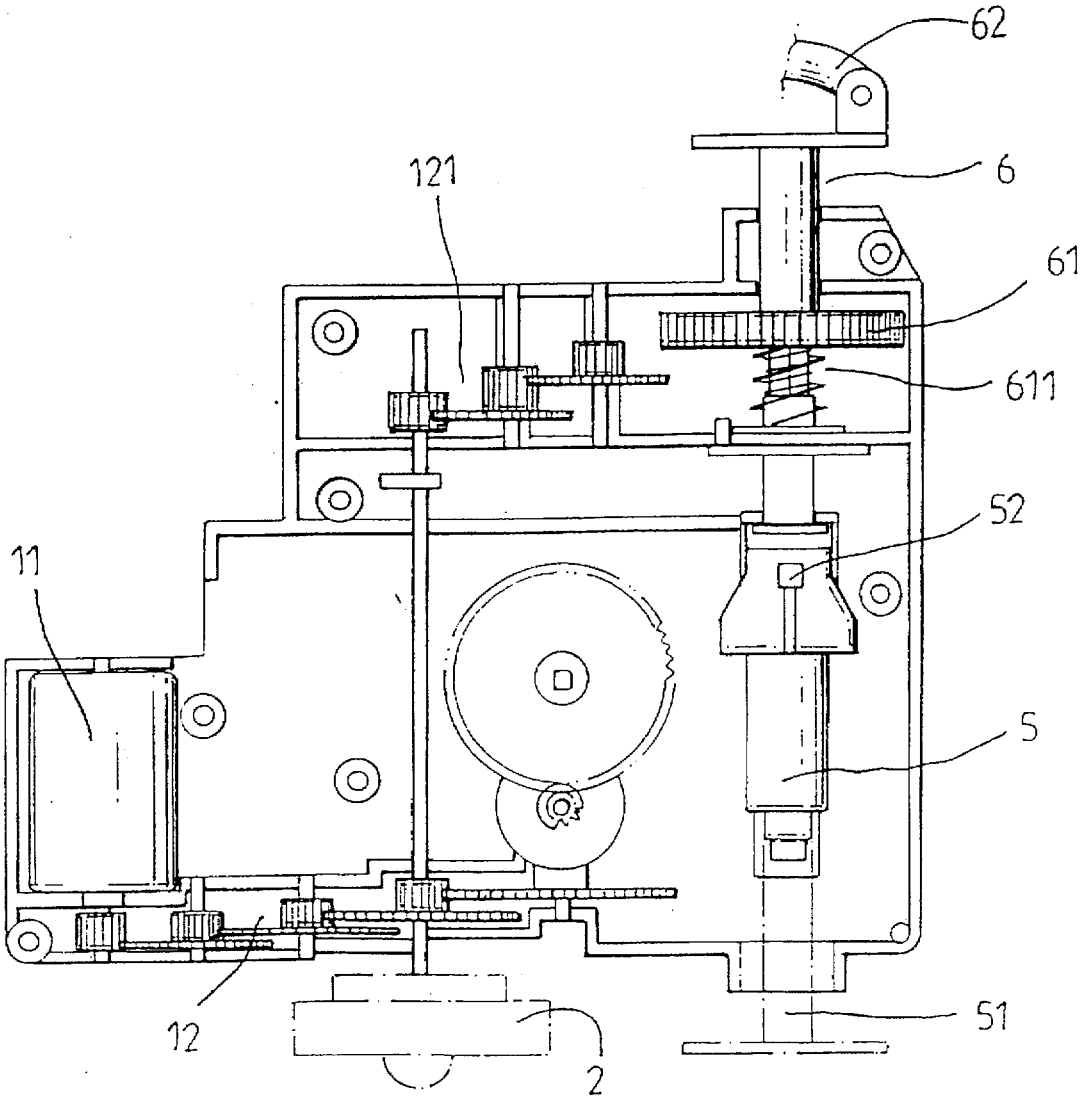
Figure 4A:
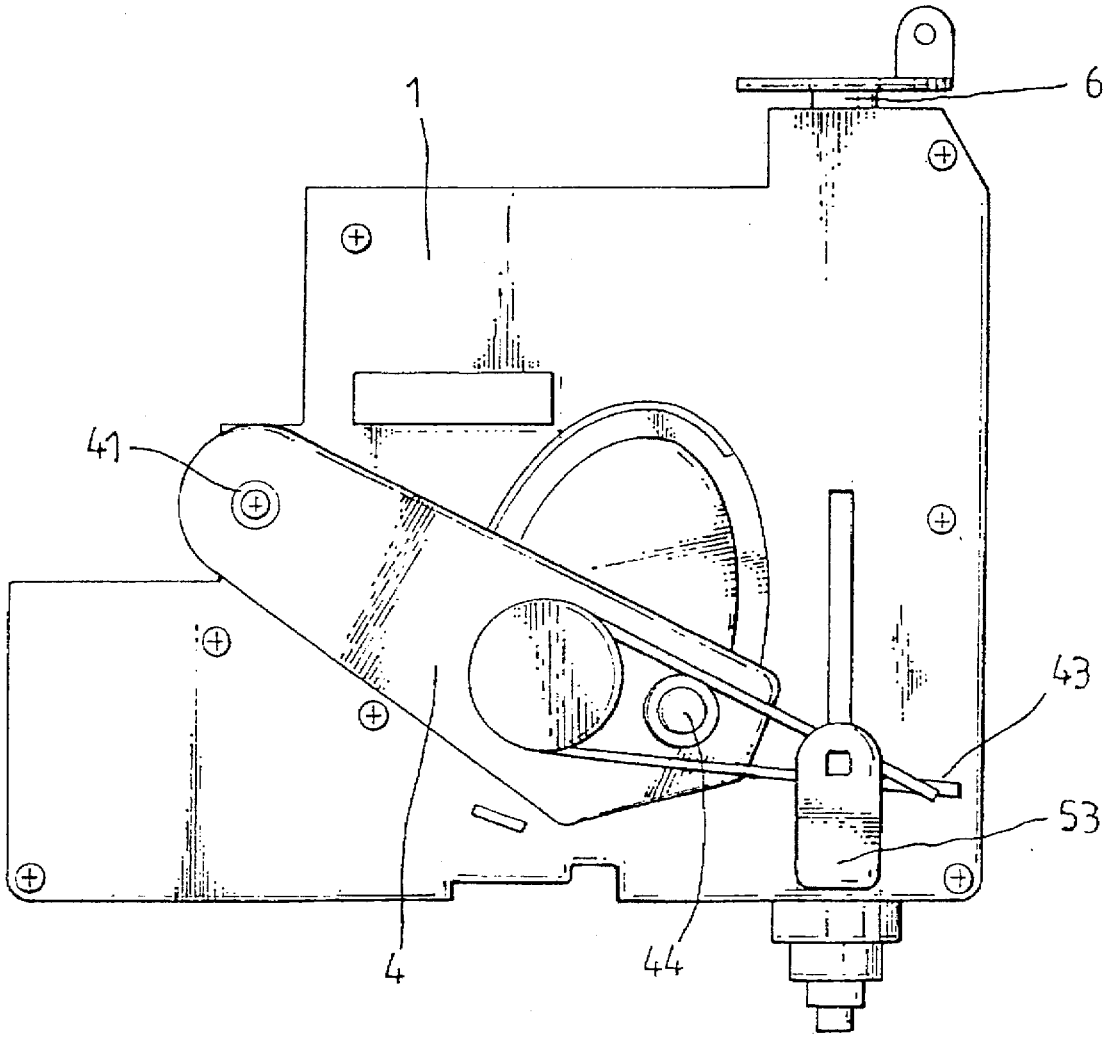
FIG. 4-A shows that the rocking arm drives the ascending/descending support shaft to descend.
Figure 4B:
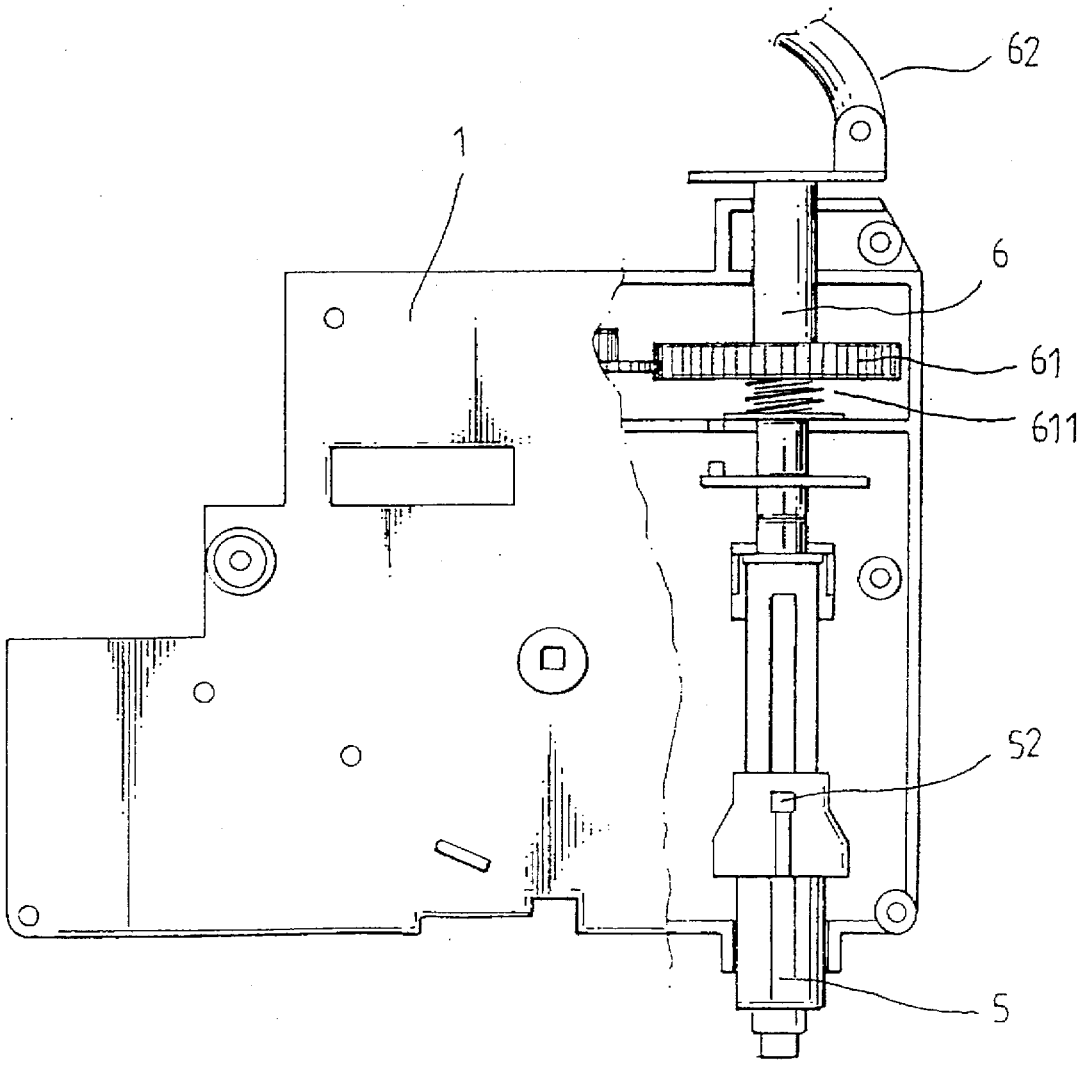
Figure 5:
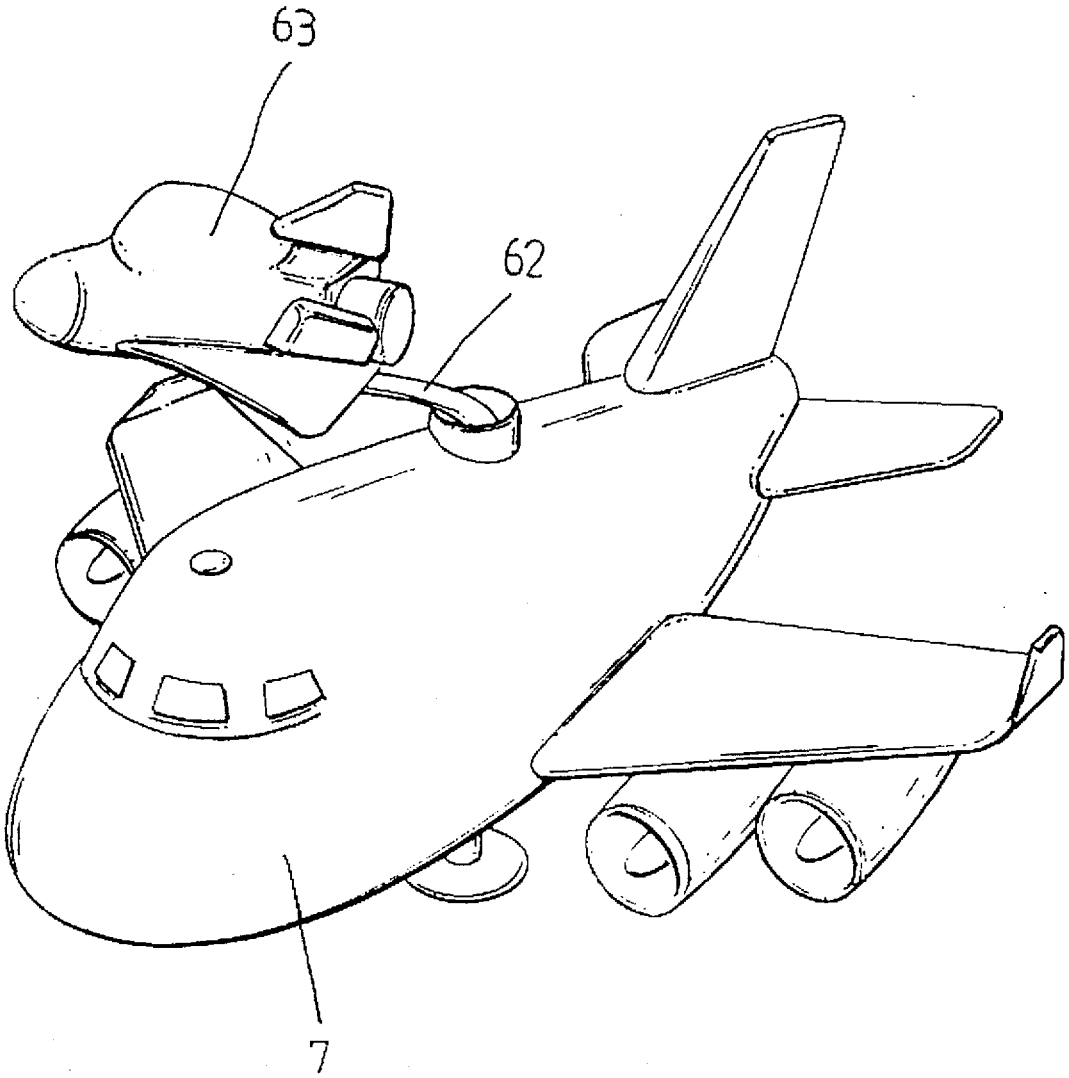
FIG. 5 shows a preferred appearance of the toy airplane of the present invention.

Please refer to FIGS. 1 to 5. The present invention includes a housing 1 and a driving means 11 (such as a motor) disposed in one end of the housing 1. The driving means 11 via a gear set 12 is connected respectively to a middle section of an engaging rotary shaft 21 and a guiding member driving shaft 31. A rotary power wheel set 2 is disposed at the bottom end of the rotary shaft 21 and an engaging gear set 121 is connected to the other end of the rotary shaft 21. The guiding member driving shaft 31 is connected to the guiding members 3 (which can be cams) disposed on two outer sides of the housing 1 for outputting power. The guiding member 3 is formed with a guiding groove 32 along the periphery. A fulcrum seat 14 and a longitudinal slot 13 are respectively formed on two sides of the housing 1. The fulcrum seat 14 is located in a fulcrum hole 41 formed at one end of a rocking arm 4. A projecting pin 42 is disposed on inner side of the other end of the rocking arm 4 and extends into the guiding groove 32 of the guiding member 3. A linking member seat 45 and a guiding seat 44 are disposed on outer side off the rocking arm 4 to cooperatively clamp a resilient linking member 43. The two end portions of the resilient linking member 43 clamp each end of an engaging support 52 extending outward from the slot 13 of the housing 1. Each end of the engaging support 52 is further engaged with an engaging board 53. Also, the bottom side of the engaging support 52 is connected to an ascending/descending support shaft 51 via a ascending/descending support seat 5. A rotary shaft 6 is disposed on top side of the ascending/descending support seat 5. A gear 61 is disposed at middle section of the rotary shaft 6 and hooked on inner side of the housing 1 by a spring 611. The top side of the rotary shaft 6 is connected to a rotary decorative body 63 via a rotary support lever 62. Accordingly, when the guiding member 3 is rotated, the projecting pin 42 is slided within the guiding groove 32 so as to drive the rocking arm 4 to swing about the fulcrum seat 14. The rocking arm 4 in turn through the guiding seat 44 and the linking member seat 45 drives the resilient linking member 43 to swing. In turn, the resilient linking member 43 draws the engaging support 52 to slide up and down within the slot 13. When the engaging support 52 is slided downward without abutting against the rotary shaft 6, the rotary shaft 6 is pulled by the spring 611 to make the gear 61 descend to engage with the engaging gear set 121 at the other end of the engaging rotary shaft 21, whereby the rotary shaft 6 starts to rotate. In the case that the engaging support 52 is slided upward to abut against the rotary shaft 6, the gear 61 is disengaged from the engaging gear set 121 and the rotary shaft 6 stops rotating.

The present invention operates in such a manner that when the driving means 11 is powered on, the gear set 12 is driven to continuously drive the engaging rotary shaft 21 which in turn drives the engaging gear set 121 and the rotary power wheel set 2 to rotate. The gear set 12 further via the guiding member driving shaft 31 drives the guiding member 3 to drive the rocking arm 4. When the resilient linking member 43 is driven by the rocking arm 4 to make the engaging support 52 move to the upper dead end of the slot 13, the body of the airplane 7 is moved downward and the rotary power wheel set 2 enables the airplane to run over the ground. At this time, the rotary shaft 6 is pushed upward by the engaging support 52, making the gear 61 disengaged from the engaging gear set 121. Therefore, the rotary shaft 6 will not rotate. When the engaging support 52 is lowered to the lower dead end, the ascending/descending support shaft 51 of the ascending/descending support seat 5 abuts against the ground to lift the airplane. At this time, the rotary power wheel set 2 is separated from the ground without action. Also, the engaging support 52 is separated from the bottom end of the rotary shaft 6 and the rotary shaft 6 is pulled downward by the spring 611 to make the gear 61 engaged with the engaging gear set 121. By means of the power of the gear set 12, the rotary shaft 6 via the rotary support lever 62 drives the rotary decorative body 63 to rotate above the airplane 7.

It should be noted that the above description and accompanying drawings are only used to illustrate some embodiments of the present invention, not intended to limit the scope thereof. Any modification of the embodiments should fall within the scope of the present invention.

What is claimed is:

1. A toy airplane with rotary decorative bodies, which comprises a power source for driving a gear set, the gear set in turn driving an engaging rotary shaft and two opposite guiding members to rotate, the engaging rotary shaft being further connected to an engaging gear set, each guiding member being formed with a guiding groove along its periphery for guiding a rocking arm to regularly swing therewithin, the rocking arm further driving a resilient linking member which is drivingly connected to an engaging support for driving an ascending/descending support seat to move up and down, a top end of the engaging support pushing a rotary shaft pulled by a spring to slide up and down, a gear being disposed at middle section of the rotary shaft, the gear being engaged with and driven by the engaging gear set, whereby a rotary support lever connected to upper end of the rotary shaft is driven to rotate a decorative body disposed outside the airplane.

2. A toy airplane as claimed in claim 1, wherein the ascending/descending support seat includes an ascending/descending support shaft for abutting against the ground to lift the airplane.

3. A toy airplane as claimed in claim 1, wherein the rotary decorative body is disposed at an end portion of the rotary support lever and is rotatable along with the rotary shaft.

4. A toy airplane as claimed in claim 1, wherein the guiding member is a cam.

5. A toy airplane as claimed in claim 1, wherein the bottom end of the engaging rotary shaft directly drives the rotary power wheel set to rotate.

* * * * *